US005825395A

United States Patent [19]

Fukuda

[11] Patent Number: 5,825,395

[45] Date of Patent: Oct. 20, 1998

[54] THERMAL HEAD

[75] Inventor: Hiroshi Fukuda, Tokyo, Japan

[73] Assignee: Fuji Photo Film Co., Ltd., Kanagawa, Japan

[21] Appl. No.: 882,228

[22] Filed: Jun. 25, 1997

Related U.S. Application Data

[63] Continuation of Ser. No. 542,325, Oct. 12, 1995.

[30] Foreign Application Priority Data

Oct. 12, 1994 [JP] Japan ..... 6/246157

[51] Int. Cl.[6] ..... B41J 2/335

[52] U.S. Cl. ..... 347/206

[58] Field of Search ..... 347/206, 200, 347/201

[56] References Cited

U.S. PATENT DOCUMENTS 5,216,951 6/1993 Yokoyama et al. ..... 347/206

5,384,585 1/1995 Okumura ..... 347/206

*Primary Examiner*—Huan H. Tran

*Attorney, Agent, or Firm*—Sughrue, Mion, Zinn, Macpeak & Seas, PLLC

[57] ABSTRACT

A thermal head having an array of a predetermined number of heating elements, wherein the length of the heating elements in the feed direction is set at a value which is in the range of from 2 to 3.5 times the feed pitch in the feed direction. Thus, when color printing is effected by heating color recording paper, it is possible to increase the size of dots even if the color of the dots has a relatively low sensitivity, thereby obtaining an image which gives no sensation of roughness and also obtaining a high density, without causing damage to the surface of color recording paper or undesired color mixing.

2 Claims, 6 Drawing Sheets

THERMAL HEAD

This is a Continuation of application Ser. No. 08/542,325, filed on Oct. 12, 1995.

BACKGROUND OF THE INVENTION

The present invention relates to a thermal head of a thermal printer. More particularly, the present invention relates to a thermal head which is suitable for use in a thermal color printer that effects color printing by directly heating paper for color thermal recording.

The present applicant has heretofore proposed various arrangements with regard to direct heating type color recording paper (hereinafter referred to as simply "color recording paper").

FIG. 5 shows an example of the arrangement of the color recording paper. On a base 1, three thermosensitive color developing layers, that is, a cyan (C) recording layer 2, a magenta (M) recording layer 3, and a yellow (Y) recording layer 4, are stacked in the mentioned order. Further, a heat-resistant protective layer 20 is provided on the topmost recording layer.

The C recording layer 2 is mainly composed of basic dye precursor and organic acid. The M recording layer 3 is composed of micro-capsules enclosing a diazonium chloride compound of high reactivity, and a magenta coupler. The Y recording layer 4 is composed of micro-capsules enclosing a diazonium chloride compound of high reactivity, and a yellow coupler. It should be noted that circles in each of the C, M and Y recording layers 2, 3 and 4 in FIG. 5 show micro-capsules.

The thermosensitive color developing layers, that is, the C recording layer 2, the M recording layer 3 and the Y recording layer 4, have respective thermal sensitivity characteristics as shown in FIG. 6 so that Y, M and C colors are successively formed in the mentioned order according to the magnitude of thermal energy given to the recording layers. It should be noted that the one-dot chain line in FIG. 6 shows the sensitivity characteristics of conventional black-and-white thermal recording paper. As will be clear from the figure, all the three color developing layers Y, M and C have a sensitivity lower than that of the conventional black-and-white thermal recording paper. The two-dot chain line in FIG. 6 shows the sensitivity characteristics of an ink which is employed in a dye diffusion thermal transfer printer. As will be clear from the figure, the Y recording layer 4 exhibits a sensitivity higher than that of the sublimation transfer ink, but the M recording layer 3 and the C recording layer 2 have a lower sensitivity than that of the sublimation transfer ink. It will also be understood from the figure that all the three color developing layers Y, M and C have higher $\gamma$ than that of the sublimation transfer ink.

Next, a full-color recording method that employs the above-described color recording paper will be explained.

First, as shown in FIG. 7A, the color recording paper is heated at low energy with a thermal head 25, thereby allowing the yellow dyestuff in the Y recording layer 4 to develop yellow color. Next, as shown in FIG. 7B, a lamp 26 which emits ultraviolet rays of a first predetermined wavelength is lit up to fix the unreacted diazo compound in the Y recording layer 4 by photolysis. Thus, the yellow dyestuff will not develop color any longer even if it is heated.

Thus, the recording of yellow color is completed, and recording of magenta color is then carried out. In this case also, as shown in FIG. 7C, the color recording paper is first heated at medium energy with the thermal head 25, thereby allowing the magenta dyestuff in the M recording layer 3 to develop magenta color. Next, as shown in FIG. 7D, a lamp 26 which emits ultraviolet rays of a second predetermined wavelength is lit up to fix the unreacted diazo compound in the M recording layer 3 by photolysis. Thus, the magenta dyestuff will not develop color any longer even if it is heated.

Thus, the recording of magenta color is completed, and recording of cyan color is then carried out. In this case, as shown in FIG. 7E, it is only necessary to heat the color recording paper at high energy with the thermal head 25 to thereby allow the cyan dyestuff in the C recording layer 2 to develop cyan color.

By executing the above-described process, full-color recording can be effected.

It should be noted that the term "printing" as used in this specification shall include not only printing of characters but also printing of images.

Incidentally, the length in the feed direction of the heating elements of a conventional thermal head used in a thermal color printer is about 1.5 times the feed pitch in the feed direction. When color recording paper is printed by using such a conventional thermal head, dots of a color of relatively low sensitivity are relatively small. As a result, when the printed image is viewed, the dots of that color look isolated. Therefore, the image gives a sensation of roughness. This phenomenon is particularly conspicuous when the feed pitch in the feed direction is about 167 $\mu$m (6 dots/mm) or about 143 $\mu$m (7 dots/mm).

Accordingly, when printing is carried out on color recording paper having sensitivity characteristics such as those shown in FIG. 6, dots of the color C particularly become small, resulting in an image which gives a sensation of roughness.

The problem that dots of a color of relatively low sensitivity become relatively small when printing is carried out on color recording paper is attributable to the temperature distribution produced by heating of heating elements, which will be explained below. Let us consider printing carried out on monochromatic recording paper which develops color at 50° C. and on monochromatic recording paper which develops color at 100° C., with a view to facilitating understanding. It is also assumed that the length of heating elements in the feed direction is about 1.5 times the feed pitch in the feed direction.

Assuming that a temperature distribution such as that shown in FIG. 8A is produced when recording paper, in which a monochromatic recording layer 5 that develops color at 50° C. is formed on a base 1, is heated with a heating element 10, as shown in FIG. 8A, the isotherm of 50° C. is a broad line having a gentle curve, as shown in FIG. 8A. Accordingly, the distribution of dye particles developing color in the recording layer 5 spreads over a relatively wide range, as shown in FIG. 8B. In other words, the resulting dot is relatively large.

Accordingly, in this case, the printed dots overlap dots which are adjacent thereto in the feed direction, as shown in FIG. 8C, so that the printed image gives almost no sensation of roughness.

FIG. 8D shows a cross-section of the recording layer 5 under the above-described circumstances. As will be understood from the figure, since in this case many dye particles develop color, a density closer to the maximum density can be obtained. The reason for this is that, since the maximum density is obtained when all the dye particles develop color, as the amount of dye particles which develop color increases, the obtained density becomes closer to the maximum density.

Meanwhile, assuming that a temperature distribution such as that shown in FIG. 9A is produced when recording paper, in which a monochromatic recording layer 6 that develops color at 100° C. is formed on a base 1, is heated with a heating element 10, as shown in FIG. 9A, the isotherm of 100° C. is a peaky line having a steep curve in comparison to the isotherm of 50° C., as shown in FIG. 9A. Accordingly, dye particles developing color in the recording layer 6 distribute as shown in FIG. 9B. As will be clear from the figure, dye particles which develop color are limited in a narrow range in comparison to the distribution shown in FIG. 8B.

Accordingly, in this case, the printed dots do not satisfactorily overlap dots which are adjacent thereto in the feed direction, and the dots look isolated, as shown in FIG. 9C. Consequently, the printed image gives a sensation of roughness.

FIG. 9D shows a cross-section of the recording layer 6 under the above-described circumstances. As will be understood from the figure, since in this case the amount of dye particles developing color is relatively small, the dyestuff cannot effectively be utilized, and high density cannot be obtained.

As will be understood from the foregoing explanation, with regard to a color which is developed at a relatively high temperature, (that is, with regard to a color of relatively low sensitivity) the printed image gives a sensation of roughness, and it is difficult to obtain a high density.

Although the foregoing discussion has been made with regard to monochromatic recording paper, the same can be said of each recording layer of color recording paper. Therefore, an image of C color whose sensitivity is relatively low and whose $\gamma$ is relatively high gives a sensation of roughness, and it is difficult to obtain a high density with the C color.

As a technique of solving the above-described problems, it is conceivable to raise the heating temperature of the heating elements while leaving the size of the heating elements unchanged. That is, if the temperature of the heating element 10 is raised in the case shown in FIG. 9A, for example, the isotherm of 100° C. becomes gentle and broad in comparison to that shown in FIG. 9A. Consequently, the resulting dots are larger than those obtained in the case of FIG. 9A. Thus, it also becomes possible to obtain a higher density.

However, if the heating temperature is raised as described above, the following additional problems arise: As the temperature of the heating elements is raised, the temperature in the vicinity of the surface layer of the recording paper also rises, and this heat may damage the recording paper.

Further, if the heating temperature is raised, such a problem also arises that undesired color mixing may occur when color printing is carried out by using color recording paper. That is, when color recording paper such as that shown in FIG. 5 is employed, if the temperature of the heating elements is raised higher than is necessary during printing of Y color, the temperature in the M recording layer 3 may rise to a temperature at which the dyestuff of M color develops color. In such a case, although only the dyestuff of Y color is originally desired to develop color, the dyestuff of M color undesirably develops color, causing undesired color mixing.

Thus, it is not advisable to raise the temperature of the heating elements to thereby improve the roughness of the printed image and obtain a higher density.

SUMMARY OF THE INVENTION

In view of the above-described problems, an object of the present invention is to provide a thermal head which is designed so that, when color printing is effected by heating color recording paper, it is possible to increase the size of dots even if the color of the dots has a relatively low sensitivity, thereby obtaining an image which gives no sensation of roughness and also obtaining a high density, without causing damage to the surface of color recording paper or undesired color mixing.

To attain the above-described object, the present invention provides a thermal head having an array of a predetermined number of heating elements, wherein the length of the heating elements in the feed direction is set at such a value that printed dots do not look isolated, and that there is no damage to the surface of recording paper, and further that no undesired color mixing occurs when printing is carried out on color recording paper.

In addition, the present invention provides a thermal head having an array of a predetermined number of heating elements, wherein the length of the heating elements in the feed direction is set at a value which is in the range of from 2 to 3.5 times the feed pitch in the feed direction.

In the first-mentioned thermal head of the present invention, the length of the heating elements in the feed direction is set at such an optimal value that printed dots do not look isolated, and that there is no damage to the surface of recording paper, and further that no undesired color mixing occurs when printing is carried out on color recording paper.

In the second-mentioned thermal head of the present invention, the length of the heating elements in the feed direction is set at a value which is in the range of from 2 to 3.5 times the feed pitch in the feed direction.

According to the above-described arrangements, the length of the heating elements in the feed direction is longer than that in the case of the conventional thermal head. Therefore, it is possible to obtain the following advantageous effects, which are unique to the present invention:

① Since it is possible to increase the size of dots even if the color of the dots has a low sensitivity, it is possible to obtain a printed image which gives no sensation of roughness;

② Since the color developing dyestuff can be effectively utilized, a high density can be obtained;

③ Since recording paper is not heated more than is necessary, no damage is done to the surface of recording paper; and ④ Since recording paper is not heated more than is necessary, no undesired color mixing occurs even when printing is carried out on color recording paper.

Further, the present invention can be suitably applied not only to a thermal color printer in which color printing is effected by heating color recording paper with a thermal head, but also to a dye diffusion thermal transfer printer. In such a case, it is possible to effectively prevent sticking of heating elements and ink paper.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENT

One embodiment of the present invention will be described below with reference to the accompanying drawings.

The above-described problems, which are to be solved by the present invention, are based on the fact that dots of a color of relatively low sensitivity are relatively small in size. Accordingly, the problems should be solvable if dots of a color of relatively low sensitivity can be made larger in size than in the case of the conventional technique. It is conceivable to raise the heating temperature of the heating elements with the size of the heating elements left unchanged as a technique of solving the above-described problems. However, this technique is not advisable, as described above.

Figure 8A:
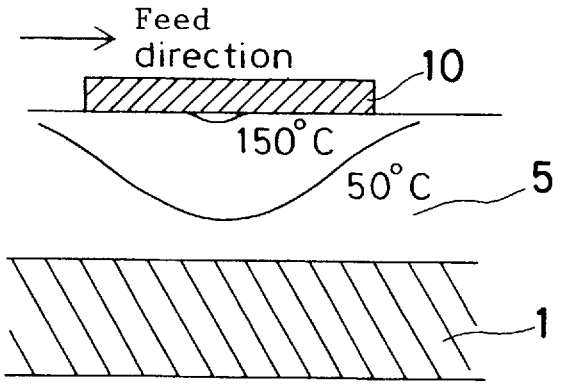
FIGS. 8A to 8D are views for explaining that dots of a color of relatively high sensitivity are relatively large in size.
Figure 8B:
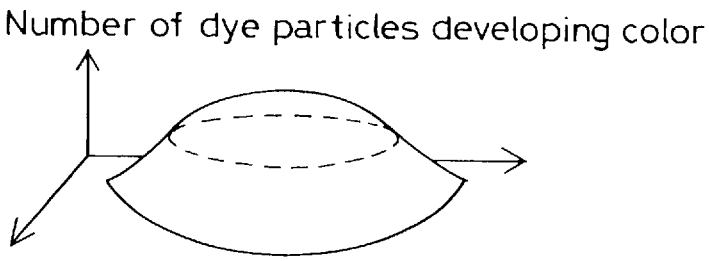
Figure 8C:
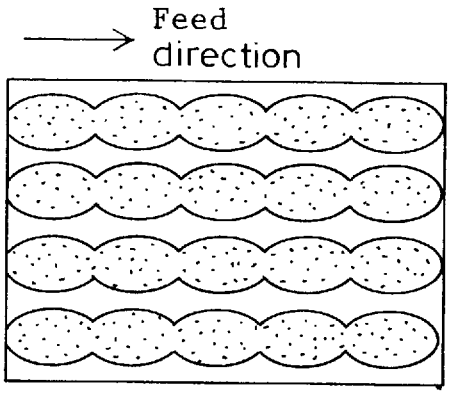
Figure 8D:
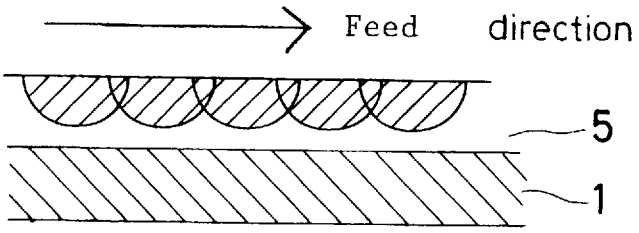
Figure 9A:
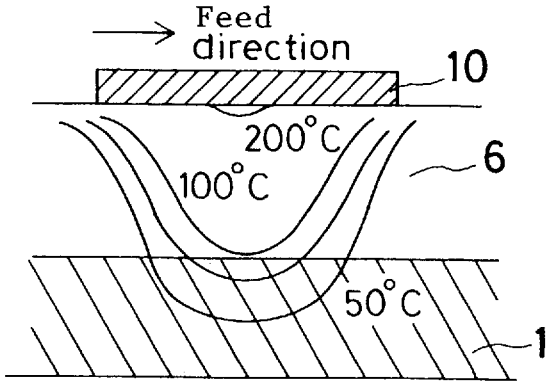
FIGS. 9A to 9D are views for explaining that dots of a color of relatively low sensitivity are relatively small in size.
Figure 9B:
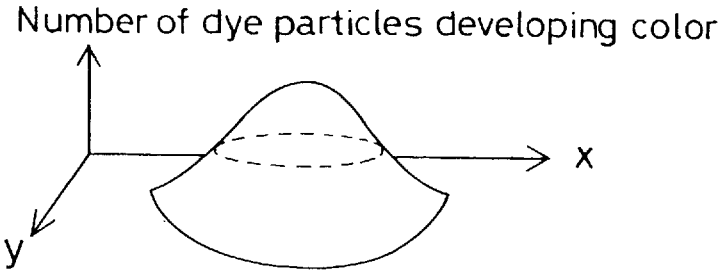
Figure 9C:
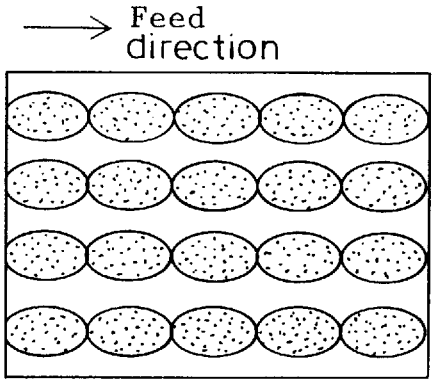
Figure 9D:
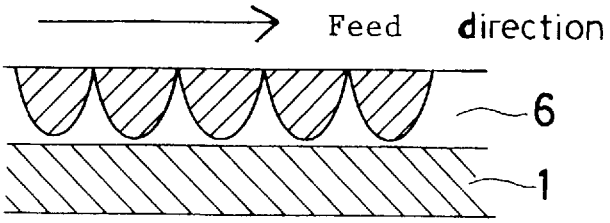

There is another conceivable technique to increase the size of dots. That is, the size of dots can be increased by increasing the size of the heating elements. More specifically, if the size of the heating elements is increased, the isotherm of a temperature at which a dyestuff can develop color can be made gentler and broader than in the case of the conventional technique without the need of raising the heating temperature. Consequently, the distribution of dye particles developing color in the recording layer spreads over a wide range in the same way as in FIG. 8B. Thus, the size of the resulting dots can be increased. Accordingly, it is possible to obtain a printed image which gives no sensation of roughness, and it is also possible to obtain a higher density.

Moreover, since the heating temperature may remain the same as in the case of the conventional technique, no damage will be done to the surface of recording paper. Further, no undesired color mixing occurs when printing is carried out on color recording paper.

Accordingly, in the present invention, the length of the heating elements in the feed direction is made longer than in the case of the conventional thermal head. In the conventional thermal head, the length of the heating elements in the feed direction is about 1.5 times the feed pitch in the feed direction, as has been described above, whereas, in the present invention, the length of the heating elements in the feed direction is longer than the above-mentioned value.

Further, in the present invention, the length of the heating elements in the feed direction is set at such a value that printed dots do not look isolated, and that there is no damage to the surface of recording paper, and further that no undesired color mixing occurs when printing is carried out on color recording paper. More specifically, the length of the heating elements in the feed direction should be set at a value which is in the range of from 2 to 3.5 times the feed pitch in the feed direction.

Figure 1:
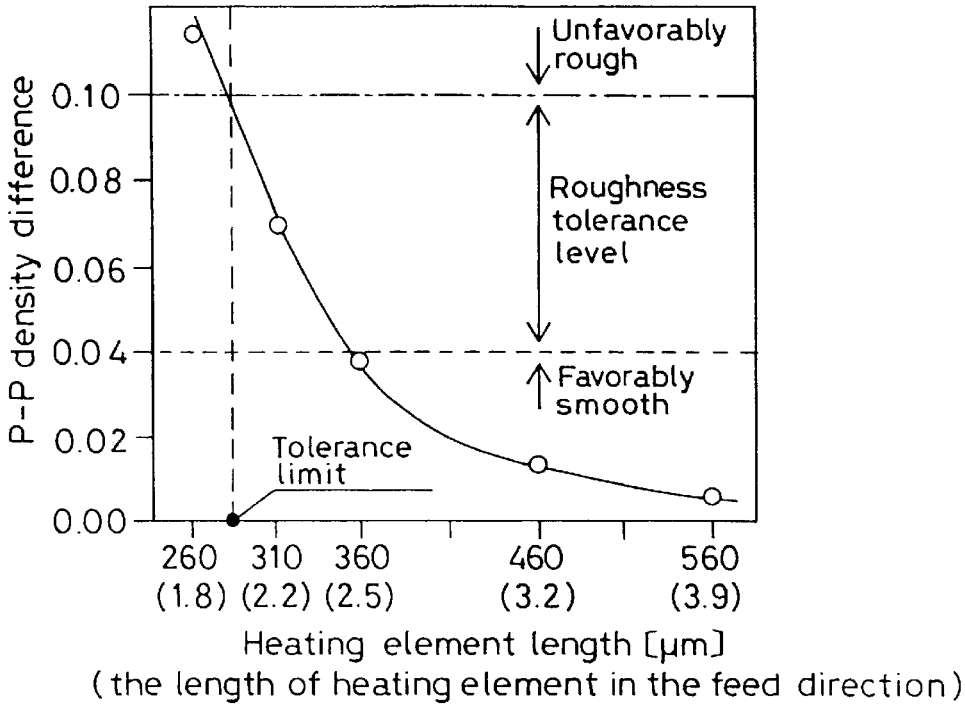
FIG. 1 is a graph for explaining the present invention.
Figure 2:
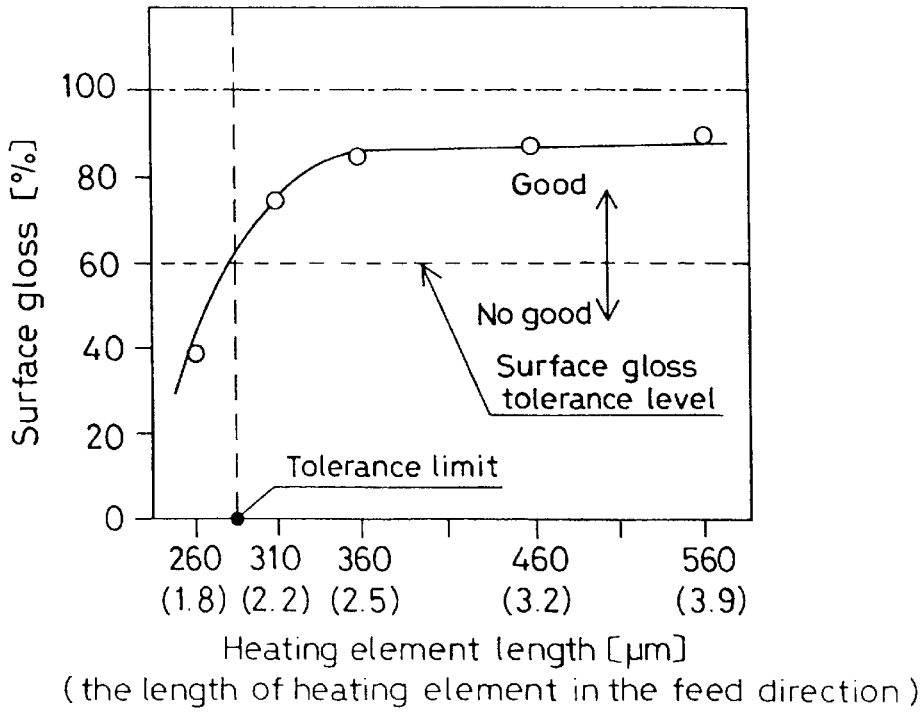
FIG. 2 is a graph for explaining the present invention.
Figure 3:
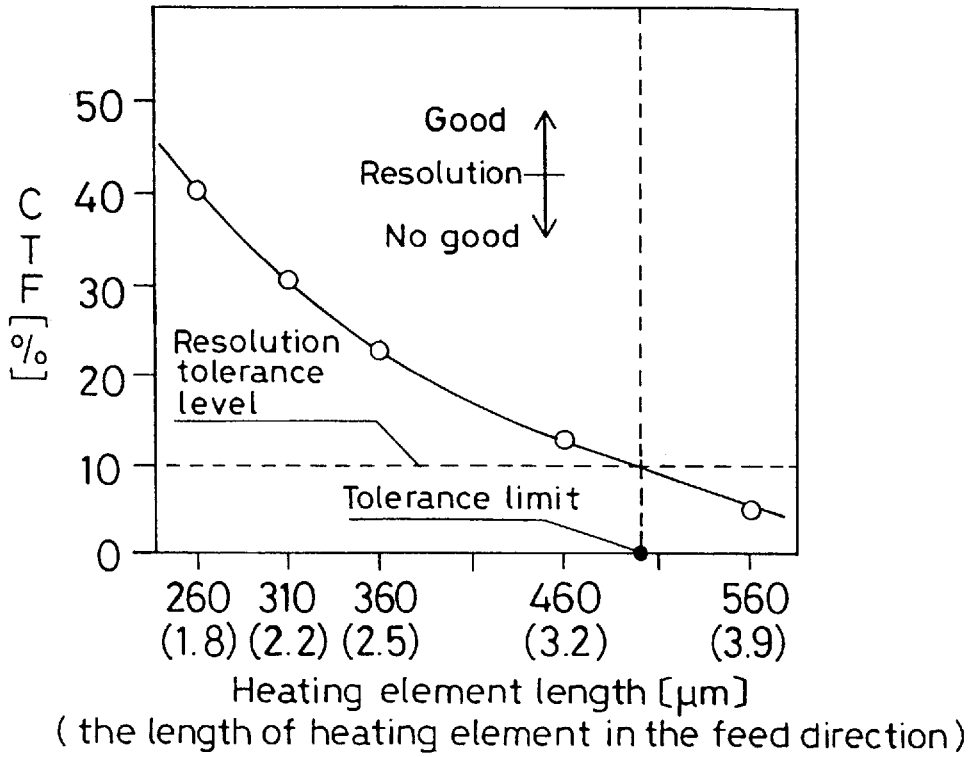
FIG. 3 is a graph for explaining the present invention.

The above-described effect of the present invention will be clear from FIGS. 1 to 3.

Figure 4:
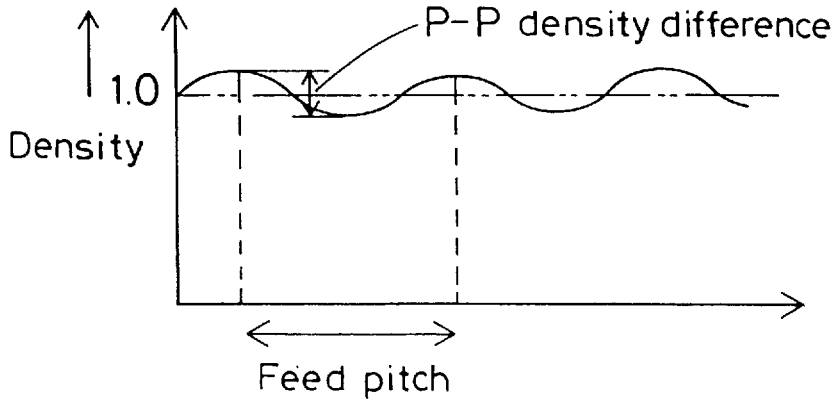
FIG. 4 is a graph for explaining the P—P density difference which is plotted along the ordinate axis of the graph shown in FIG. 1.
Figure 5:
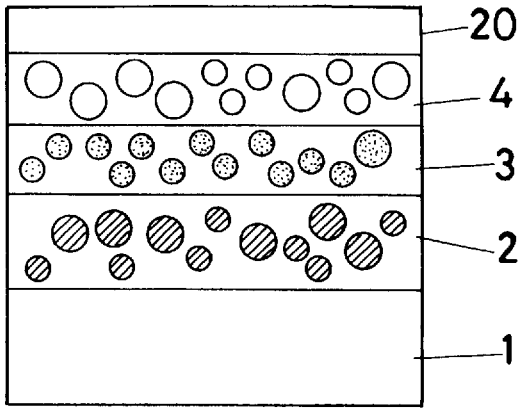
FIG. 5 shows an example of the structure of color recording paper.
Figure 6:
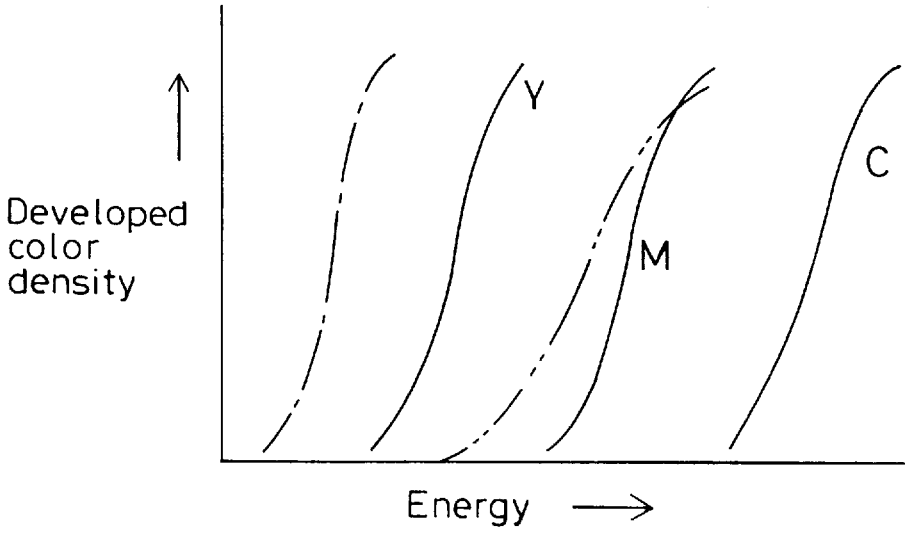
FIG. 6 is a graph for explaining sensitivity characteristics of each color in color recording paper.
Figure 7A:
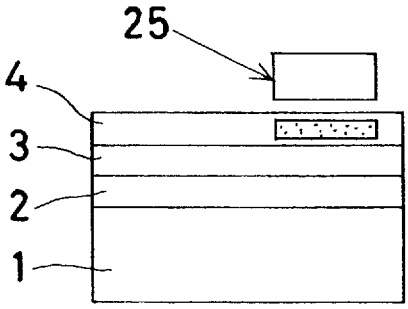
FIGS. 7A to 7E show a printing method.
Figure 7B:
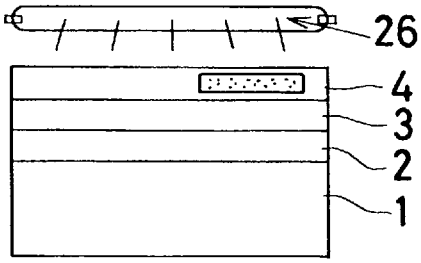
Figure 7C:
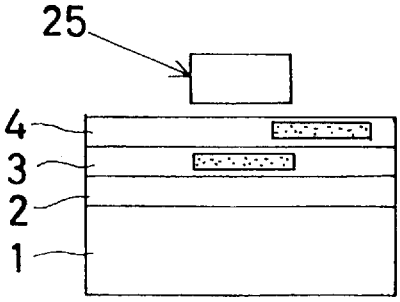
Figure 7D:
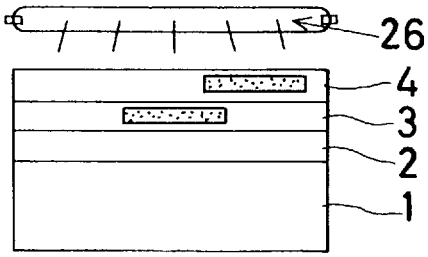
Figure 7E:
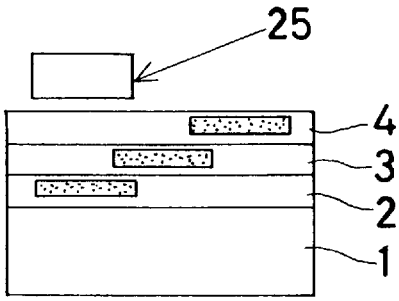

FIG. 1 is a graph showing experimental results concerning the degree of separation of dots when M color was printed solid at a density 1.0. The abscissa axis represents the heating element length, and the ordinate axis represents the peak(P)-peak(P) density difference. It should be noted that each parenthesized value along the abscissa axis is the ratio of the heating element length in the feed direction to the feed pitch in the feed direction. The P—P density difference, which is plotted along the ordinate axis of the graph in FIG. 1, is the value of the difference between the highest and lowest densities in the feed pitch in the feed direction, as shown in FIG. 4. It should be noted that the density value that is plotted along the ordinate axis of the graph in FIG. 4 is profile data obtained by measuring a density profile in the feed direction on a sample printed solid with a microdensitometer. That is, the P—P density difference is a value that indicates the degree of roughness of an image.

It will be understood from the above that FIG. 1 shows how the roughness of the printed image changes with the change of the heating element length. The tolerance for the P—P density difference is usually not more than 0.10. Therefore, if the curve shown in FIG. 1 is searched for a heating element length at which the P—P density difference is 0.10, it will be found that the heating element length is about 2 times the feed pitch in the feed direction.

FIG. 2 is a graph showing experimental results concerning the surface gloss of recording paper when gray was printed solid thereon at a density of 2.0. The abscissa axis of the graph represents the heating element length, and the ordinate axis represents the surface gloss. It should be noted that each parenthesized value along the abscissa axis is the ratio of the heating element length in the feed direction to the feed pitch in the feed direction.

The surface gloss of recording paper shows the degree of damage to the recording paper surface, and hence FIG. 2 shows the degree of damage to the surface of recording paper. The tolerance for the surface gloss is usually not less than 60%. Therefore, if the curve shown in FIG. 2 is searched for a heating element length at which the surface gloss is 60%, it will be found that the heating element length is about 2 times the feed pitch in the feed direction.

FIG. 3 is a graph showing experimental results concerning the CTF (Contrast Transfer Function) at the Nyquist frequency. The abscissa axis of the graph represents the heating element length, and the ordinate axis represents the CTF value. It should be noted that each parenthesized value along the abscissa axis is the ratio of the heating element length in the feed direction to the feed pitch in the feed direction. In this example, the Nyquist frequency is 3.5 pl/mm (pair line/mm).

It will be clear that FIG. 3 shows how the resolution changes with the change of the heating element length in the feed direction. The tolerance for the resolution is usually not less than 10%. Therefore, if the curve shown in FIG. 3 is searched for a heating element length at which the resolution is 10%, it will be found that the heating element length is about 3.5 times the feed pitch in the feed direction.

It will be understood by putting together the above-described experimental results that the length of the heating elements in the feed direction should be set in the range of from 2 to 3.5 times the feed pitch in the feed direction.

When determining a heating element length in the feed direction, it is important to take into consideration the color development sensitivity of recording paper used, the printing speed, the type of recording paper feed system, the electric energy supplied to the thermal head, etc., as a matter of course. However, it has been confirmed that, for a system in which recording paper of low sensitivity and high $\gamma$ is used, and in which high-speed printing is carried out in an intermittent drive manner by supplying high electric energy to the thermal head, it is generally preferable to set the heating element length in the feed direction at a value on the long side within the range of from 2 to 3.5 times the feed pitch in the feed direction. However, if the heating element length is made longer than is necessary, the resolution deteriorates, and the energy efficiency also lowers. Therefore, care must be taken not to set the heating element length excessively long.

Although the length of the heating elements in the feed direction is determined on the basis of experimental results, it has been confirmed that it is particularly preferable to regard as the central point the configuration of dots of M color, which is of high luminous efficacy, when optimizing the length of the heating elements in the feed direction.

A specific example will be shown below.

The length of the heating elements in the feed direction was set at 360 $\mu$m in a case where the feed pitch in the feed direction was 143 $\mu$m (7 lines/mm), the printing speed was 15 ms/line, the recording paper feed system was the continuous drive system, and the electric energy supplied to the thermal head was 0.23 W/dot. The length of 360 $\mu$m is about 2.5 times the feed pitch of 143 $\mu$m in the feed direction.

In the above case, the roughness of the printed image, the degree of damage to the surface of the recording paper, and the resolution were all within the tolerances, and no undesired color mixing was observed.

Although the present invention has been described through specific terms, it should be noted here that the described embodiment is not necessarily exclusive and that various changes and modifications may be imparted thereto without departing from the scope of the invention which is limited solely by the appended claims.

What we claim is:

1. A printing system, comprising:

a thermal head, and thermal color recording paper having a surface with a plurality of different color developing layers disposed thereon, said plurality of different color developing layers corresponding to a plurality of different colors;

said thermal head producing printed dots in a desired color developing layer over said surface of said thermal color recording paper by selectively and directly heating said thermal color recording paper, each of said dots having a respective peak position;

said thermal head comprising an array of a predetermined number of heating elements, each of said heating elements having a length in a feed direction of said thermal color recording paper and being controllable to radiate a selected level of thermal energy, said array being operationally disposed with respect to said thermal color recording paper so that said selected level of thermal energy radiated by said each heating element produces one of said printed dots;

said length of said each heating element having a value such that, at said selected level of thermal energy: adjacent ones of said printed dots have a peak-to-peak density difference of less than 0.1, said surface of said thermal color recording paper is not damaged, and undesired color mixing of said plurality of colors does not occur.

2. A printing system, comprising:

a thermal head, color thermal recording paper having a surface with a plurality of different color developing layers disposed thereon, said plurality of different color developing layers corresponding to a plurality of different colors, and means for feeding said color thermal recording paper in a feed direction at a feed pitch;

said thermal head producing printed dots in a desired color developing layer over said surface of said color thermal recording paper by selectively and directly heating said color thermal recording paper;

said thermal head comprising an array of a predetermined number of heating elements, each of said heating elements having a length, in said feed direction of said color thermal recording paper, and being controllable to radiate a selected level of thermal energy, said array being operationally disposed with respect to said color thermal recording paper so that said selected level of thermal energy radiated by said each heating element produces one of said dots without damaging said color thermal recording paper; and said length of said each heating element having a value of from 2 to 3.5 times said feed pitch.

* * * * *